US006605188B2

(12) United States Patent
Hagfors et al.

(10) Patent No.: US 6,605,188 B2
(45) Date of Patent: Aug. 12, 2003

(54) TRANSFER BELT FOR A PAPER MACHINE

(75) Inventors: Satu Hagfors, Ylojarvi (FI); Olli Jermo, Tampere (FI)

(73) Assignee: Tamfelt Oyj ABP, Tampere (FI)

( * ) Notice: Subject to any disclaimer, the term of this patent is extended or adjusted under 35 U.S.C. 154(b) by 0 days.

(21) Appl. No.: 10/098,054

(22) Filed: Mar. 15, 2002

(65) Prior Publication Data

US 2002/0137416 A1 Sep. 26, 2002

Related U.S. Application Data

(63) Continuation of application No. PCT/FI00/00883, filed on Oct. 12, 2000.

(30) Foreign Application Priority Data

Oct. 13, 1999 (FI) ..... 19992207

(51) Int. Cl.[7] ..... D21F 2/00; B32B 5/08

(52) U.S. Cl. ..... 162/306; 162/901; 442/274; 442/275

(58) Field of Search ..... 162/306, 348, 162/358.1, 358.2, 358.3, 358.4, 900, 901, 902, 903, 904, 205–207; 139/383 A, 383 AA, 425 A; 442/60, 76, 79, 104, 118, 148, 164, 168, 182, 189, 197, 268, 270, 274, 275, 277, 286–294, 301

(56) References Cited

U.S. PATENT DOCUMENTS 4,500,588 A * 2/1985 Lundstrom ..... 428/212
4,701,368 A * 10/1987 Kiuchi et al. ..... 442/226
4,931,010 A * 6/1990 Barnewall ..... 442/323
5,298,124 A * 3/1994 Eklund et al. ..... 162/306
5,829,488 A * 11/1998 Fagerholm et al. ..... 139/383 A
5,925,221 A * 7/1999 Sayers et al. ..... 162/348
6,140,260 A * 10/2000 Johnson et al. ..... 442/270
6,319,365 B1 * 11/2001 Inoue ..... 162/306
6,383,339 B1 * 5/2002 Gstrein ..... 162/358.4

FOREIGN PATENT DOCUMENTS

EP 0 480 868 A1 * 4/1992 ..... D21F/7/08
WO WO 99/16964 4/1999

* cited by examiner

*Primary Examiner*—Steven P. Griffin
*Assistant Examiner*—Eric J Hug
(74) *Attorney, Agent, or Firm*—Oliff & Berridge PLC

(57) ABSTRACT

Transfer belt for a paper machine, comprising a base structure (2) and a fiber batt layer (3) attached to the base structure and facing the fiber web. At least the fiber batt layer side of the belt is provided with a polymer matrix (4) impregnating the fiber batt layer (3). According to the idea of the invention, the transfer belt fiber batt layer comprises at least two fibers with different surface properties, the transfer belt surface facing the fiber web being thus provided with hydrophilic and, correspondingly, hydrophobic areas. The fibers in the fiber batt layer may differ from one another with regard to their polarity, hydrophilicity, electric charge, surface energy, friction properties, degree of fineness or porosity.

11 Claims, 1 Drawing Sheet

TRANSFER BELT FOR A PAPER MACHINE

FIELD OF THE INVENTION

This application is a Continuation of International PCT/FI00/00883 filed Oct. 12, 2000 which designated the U.S. and was published under PCT Article 21(2) in English.

The invention relates to a transfer belt for a paper machine, the transfer belt comprising a base structure, a fibre batt layer attached to the base structure and arranged to face the fibre web, and a polymer matrix arranged at least on the fibre batt layer side to impregnate the fibre batt layer, the fibres batts extending to the surface of the polymer matrix on the belt surface facing the fibre web.

BACKGROUND OF THE INVENTION

Transfer belts coated with a polymer or those impregnated throughout with a polymer material have been disclosed in various publications, such as U.S. Pat. Nos. 4,483,745; 4,976,821; 4,500,588; and 4,529,643. In addition, such belts have been described in Finnish Patents 64959 and 64960.

This kind of a transfer belt is typically made by coating a conventional support structure with a polymer material, or by filling the fabric structure entirely with the polymer material. It is also known to impregnate so-called paper machine felt, i.e. to needle a fibre batt layer onto a woven structure, with a polymer material.

A transfer belt is used for transferring the fibre web for example from a press felt or a press fabric forward to a press nip, for transferring it from the press nip onward and finally for transferring the fibre web to another texture or belt. The transfer belt can also be used for other purposes in the paper machine to transfer the fibre web from one process stage to another. A typical feature in these applications is that the fibre web follows more easily a surface to which the force caused by water contained in the fibre web best attaches the web. Therefore the fibre web follows most easily a substantially smooth surface impermeable to water and/or air. An essential problem is that it is difficult to detach the fibre web from this kind of known surface structure, particularly when the fibre web is still wet.

BRIEF DESCRIPTION OF THE INVENTION

It is an object of the present invention to provide a transfer belt which has suitable surface properties allowing the fibre web to be detached from the belt in a desired manner and ensuring, at the same time, an advantageous transfer belt behaviour during the pressing stage.

The transfer belt of the invention is characterized in that the transfer belt surface facing the fibre web is provided with hydrophilic and, correspondingly, hydrophobic areas and that the hydrophilic and hydrophobic areas are formed by providing the fibre batt layer of the transfer belt with at least two fibres having different surface properties.

An essential idea of the invention is that the transfer belt surface facing the fibre web is made of a fibre layer impregnated with a polymer and comprising fibres of different surface properties. The fibres may differ from one another with respect to their polarity, hydrophilicity, electric charge, surface energy, friction properties or porosity, the transfer belt surface being thus provided with areas having different properties. Another essential idea of the invention is that the surface is ground to be suitably smooth, the fibres on the surface maintaining, however, a certain micro-roughness on it. This roughness can be controlled not only by the roughness of the abrasive means but also by the degree of fineness of the fibre. Hence, when the transfer belt is subjected to compression, the surface becomes smooth and the water included in the fibre web forms a film which spreads evenly onto the surface. Correspondingly, when the compression ceases, the micro-roughness of the surface is restored and the water film breaks into drops. The water then enters the hydrophilic areas and leaves the hydrophobic areas. As a result, the fibre web is no longer firmly attached to the transfer belt, but it can be easily detached from it.

BRIEF DESCRIPTION OF THE DRAWINGS

The invention will be described in greater detail in the accompanying drawing, in which.

DETAILED DESCRIPTION OF THE INVENTION

Figure 1:
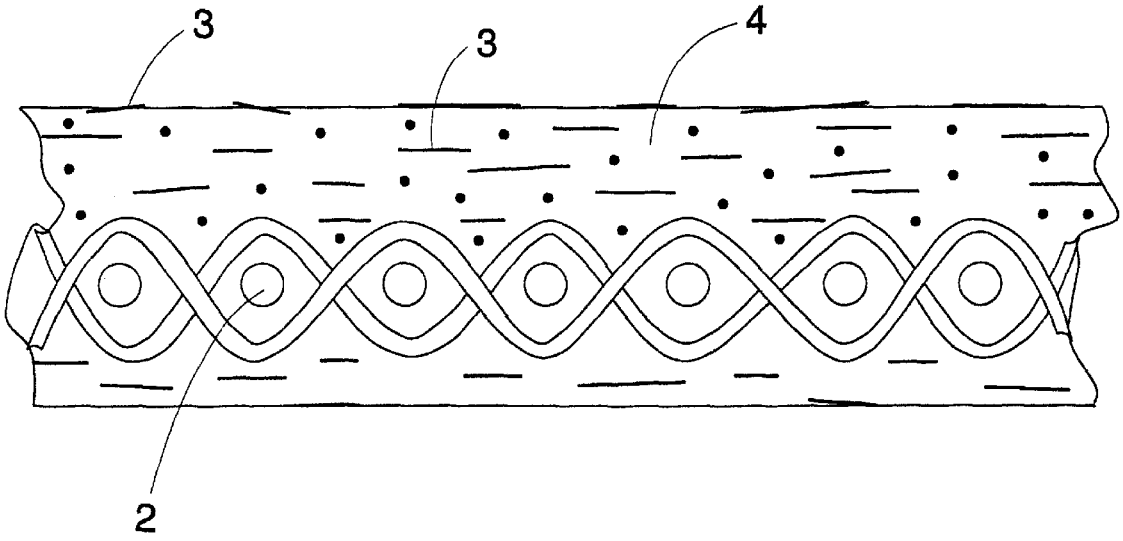
FIG. 1 is a schematic, cross-sectional view of a transfer belt structure of the invention.

FIG. 1 is a schematic, cross-sectional view of a transfer belt structure of the invention. The transfer belt 1 comprises a base structure 2, which may be any ordinary woven or non-woven texture. The base structure 2 has batt fibres 3 needled thereto to form a fibre batt layer onto its outer surfaces. In addition, the transfer belt 1 further comprises a polymer material 4 applied to the belt surface facing the fibre web, i.e. the upper surface in the Figure, to impregnate the fibre batt layer of the belt. The polymer matrix 4 thus formed is then ground so that an outer surface of a desired roughness is obtained, the batt fibres extending to the surface of the polymer layer. The transfer belt is most preferably ground so that its roughness value $Rz>2\ \mu m$ to allow a sufficient degree of roughness to be obtained. To allow the desired properties to be achieved in the manufacture of the transfer belt, the fibre batt layer is made by mixing together suitable fibres which are selected on the basis of their hydrophilicity, hydrophobicity, resistance to wear, degree of fineness, etc. so that suitably differing properties will be obtained. These different fibres can be mixed together in a suitable manner and then attached to the base structure for example by needling, as a result of which a suitable distribution of different fibres is produced. Next, at least the transfer belt layer facing the fibre web is entirely impregnated with the polymer material. Finally, the polymer layer is ground to a suitable roughness, whereby fibres are exposed on the surface of the transfer belt. The structure thus formed provides a transfer belt surface having suitably alternating hydrophilic and hydrophobic areas, the transfer belt therefore behaving in a desired manner during stages of compression and non-compression alike.

Figure 2:
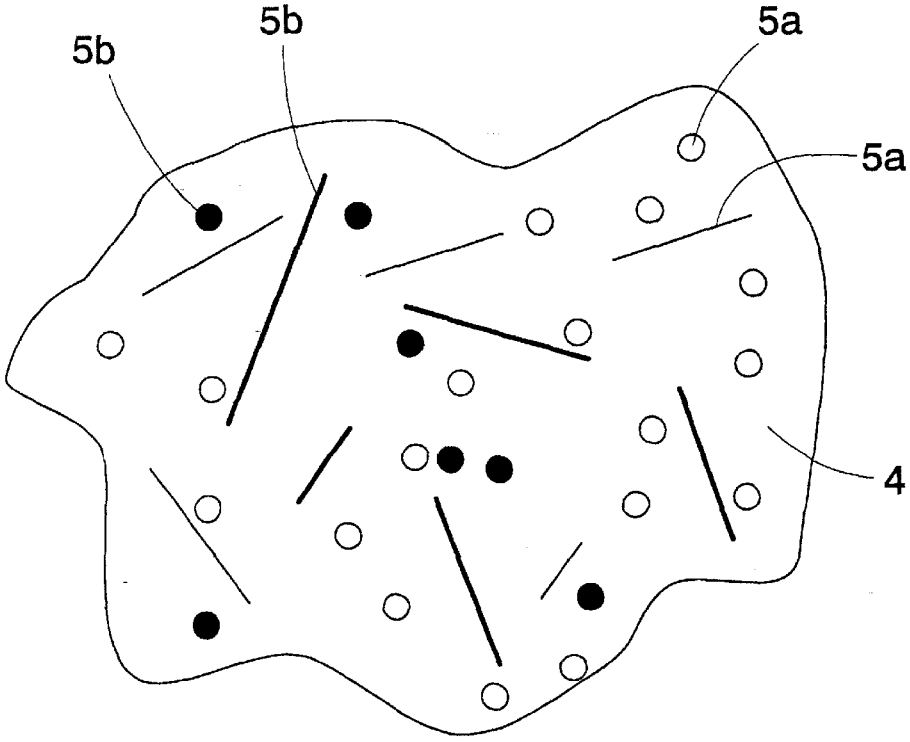
FIG. 2 is a schematic, enlarged top view of the surface of the transfer belt of the invention in its non-compressed form.

FIG. 2, in turn, shows an embodiment of a transfer belt surface according to the invention seen from the surface side when the transfer belt is not subjected to compression. Darkening has been used in the FIG. 2 to distinguish areas 5*a* and 5*b* made of different fibres from one another, lighter areas 5*a* being hydrophobic and darker areas 5*b* hydrophilic. The fibre web adheres to the uniform water layers on the darker areas 5*b* of the transfer belt, but tends to detach from areas 5*a* due to their water-repellent properties. Hence the fibre web does not adhere firmly to the transfer belt but is easy detach from it.

The fibre material to be used may vary depending on the purpose of use and the fibre web to be processed. The hydrophilic fibres that may be used include cellulose, viscose, animal fibres, polyvinyl alcohol, various polyamides, polyacrylnitrile, etc. Correspondingly, the hydrophobic fibres that may be used include fluoridated fibres, such as polytetrafluoroethylene and polyvinyliden fluoride, polyolefines, such as polyethylene and polypropylene, polyesters, such as polyethylene terephalatate and polybutylene terephalatate, and the like. In addition, different glass, carbon or metal fibres can be used.

The fineness of the batt fibres may be for example 3.1–67 dtex, or they may even be microfibres having a fineness of less than 2 dtex. The fibres may be either of the same degree or of different degrees of fineness, and their length may be typically 10 to 150 mm before needling. When rougher fibres are used, the end result is also a rougher surface, and the web detaches more easily. Different combinations of the polymer and the fibres to be used can thus be chosen according to the purpose of use. The fibres may also have different cross-sectional profiles, for example annular or angled. Further, the outer surface of the fibres may be treated with a suitable coating agent to facilitate the manufacturing.

The polymer used in the impregnation may be polyurethane, polycarbonate urethane, polyacrylate, or their mixture, or another polymer suitable for the purpose. The hydrophilicity or hydrophobicity of the polymer is preferably substantially different than that of the fibre used.

In the following, two examples of possible transfer belt structures will be described.

EXAMPLE 1

The transfer belt base is made of ordinary, woven press felt support fabric weighing 640 g/m$^2$ to which 1000 g/m$^2$ of fibre mixture is needled, the fibre mixture comprising 20% of 3.1 dtex UHMW-PE (Ultra High Molecular Weight Polyethylene) fibre and 80% of 6.7 dtex PA 6 fibre. 800 g/m$^2$ of the fibre is on the belt side facing the paper web and 200 g/m$^2$ is on the roller side of the belt.

The belt side facing the paper web is impregnated with a polyurethane water dispersion, the water dispersion being treated by applying heat and a suitable agent. The belt surface is made smooth by grinding it with an abrasive paper of fineness grade 180. After the abrasion, the belt surface is provided with hydrophobic PE areas and hydrophilic PA areas, with polyurethane as the matrix.

EXAMPLE 2

The support fabric described above is provided with 1000 g/m$^2$ fibre mixture needled thereto, the mixture comprising 34% of 3.1 dtex PA fibre, 33% of 11 dtex PA fibre and 33% of PA fibre. The belt is impregnated with a polycarbonate urethane dispersion which is treated by applying heat and a suitable agent. The surface is ground with an abrasive paper of fineness grade 60. After the abrasion, the surface has a micro-roughness provided by hydrophilic PA areas of various sizes and varying roughness, with polycarbonate urethane used as the matrix.

Further, in cases where the felt structure is to be blocked by applying the polymer to one side of the felt only, it is possible to arrange a blocking layer between the support fabric and the fibre baft layer to prevent the polymer from being absorbed through the felt. The paper web side can thus be impregnated so that it is completely clogged, without the risk of the polymer penetrating entirely through the transfer belt. This kind of a blocking layer can be provided for example by means of a plastic film, a meltable non-woven fabric, or a molten fibre layer which melts into a uniform blocking layer when subjected to thermal treatment. The blocking layer in question is made of polyethylene, polypropylene, copolyamide or a similar material which melts at a low temperature. After the fibre batt layer is needled, the blocking layer still comprises through pores, but the thermal treatment to which the blocking layer material is then subjected melts the material, whereby an impervious, or at least nearly impervious, blocking layer is formed. The following example illustrates this kind of a transfer belt structure:

EXAMPLE 3

A lighter support fabric weighing 500 g/m$^2$ is used. The fibre used may consist of the same fibre mixture as the one in Example 1. Between the support fabric and the fibre there is provided a meltable fibre, or a non-woven fabric layer, weighing 20–80 g/m$^2$.

The specification and the accompanying drawings only describe the invention with reference to an example, the invention being in no way restricted to it. An essential aspect is that the fibre batt layer attached to the woven base structure to form the transfer belt is treated with a polymer material so that at least the fibre batt layer portion facing the fibre web is impregnated with the polymer material, the surface of the polymer matrix being then ground so that the batt fibres reach the surface of the transfer belt. A test that was carried out showed that a transfer belt roughness where $2<Rz<80$ $\mu$m and $1<Ra<30$ $\mu$m is advantageous. Another essential aspect of the invention is that the fibre batt layer material and the polymer layer chosen for the belt are used for forming different areas having differing surface properties due to which water tends to collect in some areas of the transfer belt and to leave others, thereby allowing the fibre web to be more easily detached from the surface of the transfer belt. The polymer matrix can be formed by impregnating the fibre batt layer only on the surface facing the fibre web. Another alternative to form the matrix is to impregnate a thicker portion of the transfer belt, or the entire transfer belt. The impregnating layer can also be formed on both surfaces of the transfer belt in such a way that the belt's core portion is left unimpregnated.

What is claimed is:

1. A transfer belt for a paper machine, comprising:

a base structure, a fibre batt layer attached to the base structure and arranged to face the fibre web, a polymer matrix arranged at least on the fibre batt layer side to impregnate the fibre batt layer, the batt fibres extending to the surface of the polymer matrix on the belt surface facing the fibre web, the transfer belt surface facing the fibre web is provided with hydrophilic and hydrophobic fibres forming hydrophilic and hydrophobic areas, the hydrophilic and hydrophobic areas are formed by providing the fibre batt layer of the transfer belt with at least two fibres having different surface properties.

2. A transfer belt according to claim 1, wherein the surface of the transfer belt is ground in connection with the manufacture to a roughness where $Rz>2$ $\mu$m.

3. A transfer belt according to claim 1, wherein the batt fibres are mixed together before they are needled.

4. A transfer belt according to claim 1, wherein the transfer belt comprises batt fibres of varying fineness.

5. A transfer belt according to claim 1, wherein the impregnating material is polyurethane.

6. A transfer belt according to claim 1, wherein the hydrophilic fibres used include at least some of the following materials: cellulose, viscose, polyvinyl alcohol, polyamides, and polyacrylnitriles.

7. A transfer belt according to claim 1, wherein the hydrophobic fibres used include at least some of the following materials: fluoridated fibres, polytetrafluoroethylene, polyvinyliden fluoride, polyolefines, polyethylene and polypropylene, polyesters, polyethylene terephalatate, and polybutylene terephalatate.

8. A transfer belt according to claim 1, wherein the base structure is a paper machine fabric.

9. A transfer belt according to claim 1, wherein the transfer belt is substantially entirely impregnated with the polymer matrix.

10. A transfer belt for a paper machine, comprising:

a base structure, a fibre batt layer attached to the base structure and arranged to face the fibre web, a blocking layer between the base structure and the fibre batt layer, whereby only the fibre batt layer on the fibre web side of the transfer belt is impregnated with a polymer matrix, the batt fibres extending to the surface of the polymer matrix on the belt surface facing the fibre web, the transfer belt surface facing the fibre web is provided with hydrophilic and, correspondingly, hydrophobic areas, and the hydrophilic and hydrophobic areas are formed by providing the fibre batt layer of the transfer belt with at least two fibres having different surface properties.

11. A transfer belt for a paper machine, comprising:

a base structure, a fibre batt layer attached to the base structure and arranged to face the fibre web, a blocking layer between the base structure and the fibre batt layer, whereby only the fibre batt layer on the fibre web side of the transfer belt is impregnated with a polymer matrix, the batt fibres extending to the surface of the polymer matrix on the belt surface facing the fibre web, the transfer belt surface facing the fibre web is provided with hydrophilic and, correspondingly, hydrophobic areas, the hydrophilic and hycdrophobic areas are formed by providing the fibre batt layer of the transfer belt with at least two fibres having different surface properties; and wherein the blocking layer is made of a polymer which melts at a low temperature, and that the blocking layer is sealed after a needling phase by subjecting the transfer belt to a thermal treatment which closes up pores in the blocking layer structure, thereby rendering the blocking layer substantially impermeable.

* * * * *